US007393368B2

(12) United States Patent
Inuzuka et al.

(10) Patent No.: US 7,393,368 B2
(45) Date of Patent: Jul. 1, 2008

(54) DYEING METHOD OF DYEING PLASTIC LENS AND DYEING DEVICE

(75) Inventors: Minoru Inuzuka, Hazu-gun (JP); Naohide Isogai, Gamagori (JP)

(73) Assignee: Nidek Co., Ltd., Gamagori-shi (JP)

( * ) Notice: Subject to any disclaimer, the term of this patent is extended or adjusted under 35 U.S.C. 154(b) by 0 days.

(21) Appl. No.: 11/280,285

(22) Filed: Nov. 17, 2005

(65) Prior Publication Data

US 2006/0075583 A1 Apr. 13, 2006

Related U.S. Application Data

(62) Division of application No. 10/628,377, filed on Jul. 29, 2003, now Pat. No. 7,014,664.

(30) Foreign Application Priority Data

Aug. 5, 2002 (JP) ..... 2002-227291
Aug. 30, 2002 (JP) ..... 2002-253947

(51) Int. Cl.
*D06P 5/28* (2006.01)

(52) U.S. Cl. ..... 8/471; 8/507

(58) Field of Classification Search ..... 8/507, 8/471

See application file for complete search history.

(56) References Cited

U.S. PATENT DOCUMENTS 4,211,823 A * 7/1980 Suzuki et al. ..... 428/412
5,021,091 A * 6/1991 Takarada et al. ..... 106/287.16
5,914,193 A * 6/1999 Ono et al. ..... 428/451
6,520,999 B1 2/2003 Kamata et al.
2001/0014988 A1 8/2001 Inuzuka

FOREIGN PATENT DOCUMENTS

EP 0982432 * 3/2000

* cited by examiner

*Primary Examiner*—Lorna M. Douyon
*Assistant Examiner*—Amina Khan
(74) *Attorney, Agent, or Firm*—Oliff & Berridge, PLC

(57) ABSTRACT

A dyeing method of a plastic lens (10), including the steps of placing the lens (10) in a vacuum vapor deposition device (20); placing a base body (1) for dyeing in the vapor deposition device (20), the base body having a dye application area (2) in which a sublimatable dye is applied, so that the dye application area (2) faces a surface of the lens to be dyed; and heating the base body (1) in the vapor deposition device (20) under almost a vacuum, while restraining a rise in temperature of the lens (10), to sublimate the dye, depositing the sublimed dye on the lens.

3 Claims, 4 Drawing Sheets

DYEING METHOD OF DYEING PLASTIC LENS AND DYEING DEVICE

This is a Division of U.S. application Ser. No. 10/628,377 filed Jul. 29, 2003 now U.S. Pat. No. 7,014,664. The entire disclosure of the prior application is hereby incorporated by reference herein in its entirety.

BACKGROUND OF THE INVENTION

1. Field of the Invention

The present invention relates to a dyeing method of dyeing a plastic lens and a dyeing device.

2. Description of Related Art

Conventionally, a dip dyeing method has been adopted in most cases as one of dyeing methods of dyeing plastic lenses for spectacles. This dip dyeing method includes the steps of: preparing a dyeing solution by mixing disperse dyes of primary colors of red, blue, and yellow at a predetermined ratio and dispersing the mixture in water; heating the dyeing solution to about 90° C.; and dipping a plastic lens into the heated solution, thereby dyeing the lens.

As an alternative to the dip dyeing method, there has been proposed a vapor deposition dyeing method, which is for example disclosed in U.S. Pat. No. 6,520,999 (Japanese patent unexamined publication No. 2001-59950). This method includes heating a sublimatable dye under vacuum to sublimate the dye and vapor deposit the sublimed dye onto a lens, thereby dyeing the lens. According to this vapor deposition dyeing method, a lens made of a material hard to dye by the conventional dip dyeing method can also be dyed and additionally working conditions can extremely be improved.

If the dyeing is repeatedly performed by the above vapor deposition dyeing method, however, there may be cases where lenses are dyed in different color densities from desired ones depending on the condition in each dyeing operation.

Furthermore, a hard-coating treatment is well known to enhance the surface strength (hardness) of a lens. Such hard-coated lens is desired to be dyed by the vapor deposition dyeing method.

SUMMARY OF THE INVENTION

The present invention has been made in view of the above circumstances and has an object to overcome the above problems and to provide a method of dyeing a plastic lens with stable reproducibility in color density even where dyeing operations are repeated, and a dyeing device.

Another object of the present invention is providing a method of dyeing a hard-coated plastic lens.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the purpose of the invention, there is provided a dyeing method of a plastic lens, including the steps of: placing the lens in a vacuum vapor deposition device; placing a base body for dyeing in the vapor deposition device, the base body having a dye application area in which a sublimatable dye is applied, so that the dye application area faces a surface of the lens to be dyed; and heating the base body in the vapor deposition device under almost a vacuum, while restraining a rise in temperature of the lens, to sublimate the dye, depositing the sublimed dye on the lens.

According to another aspect of the invention, there is provided a dyeing device for dyeing a plastic lens, including: a lens placing unit with which the lens is placed in the dyeing device; a base body placing unit with which a base body for dyeing is placed in the device, the base body having a dye application area in which a sublimatable dye is applied, so that the dye application area faces a surface of the lens to be dyed; a pump which produces almost a vacuum in the device; a heating unit which heats the base body placed in the device to sublimate the dye, depositing the sublimed dye on the lens; and a cooling unit which cools the device to restrain the temperature rise of the lens.

Furthermore, according to another aspect of the invention, there is provided a dyeing method of dyeing a plastic lens, including the steps of: making a hard coat layer on the lens from a hard coating liquid containing tetrafunctional silane in a solids content of 30% or less by weight; placing the lens on which the hard coat layer is made in a vacuum vapor deposition device; placing a base body for dyeing in the vapor deposition device, the base body having a dye application area in which a sublimatable dye is applied, so that the dye application area faces a surface of the lens to be dyed; and heating the base body in the vapor deposition device under almost a vacuum to sublimate the dye, depositing the sublimed dye on the lens.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings.

DETAILED DESCRIPTION OF THE PREFERRED EMBODIMENTS

Figure 1:
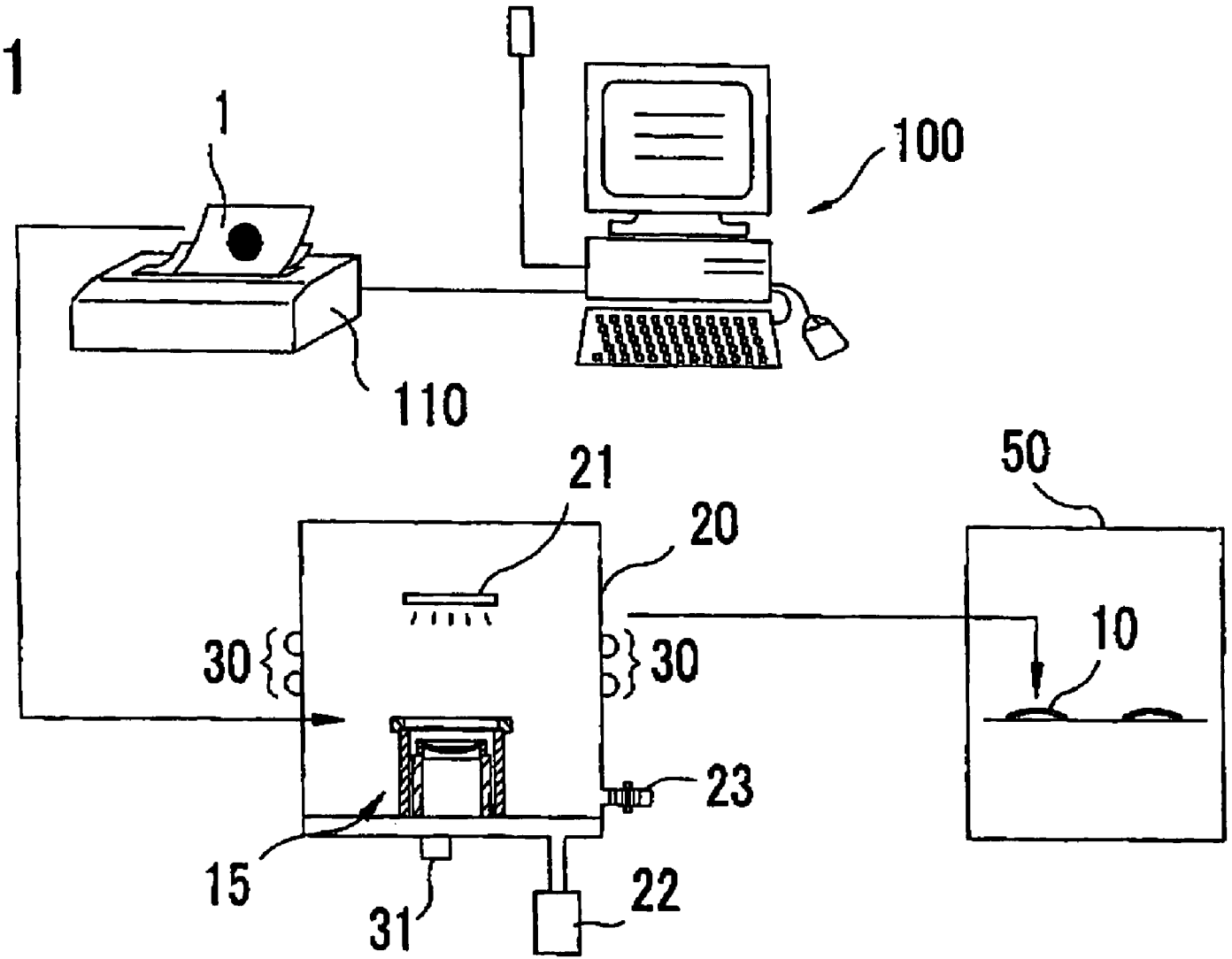
FIG. 1 is a schematic structural view of a system for dyeing a plastic lens in an embodiment according to the present invention.
Figure 2:
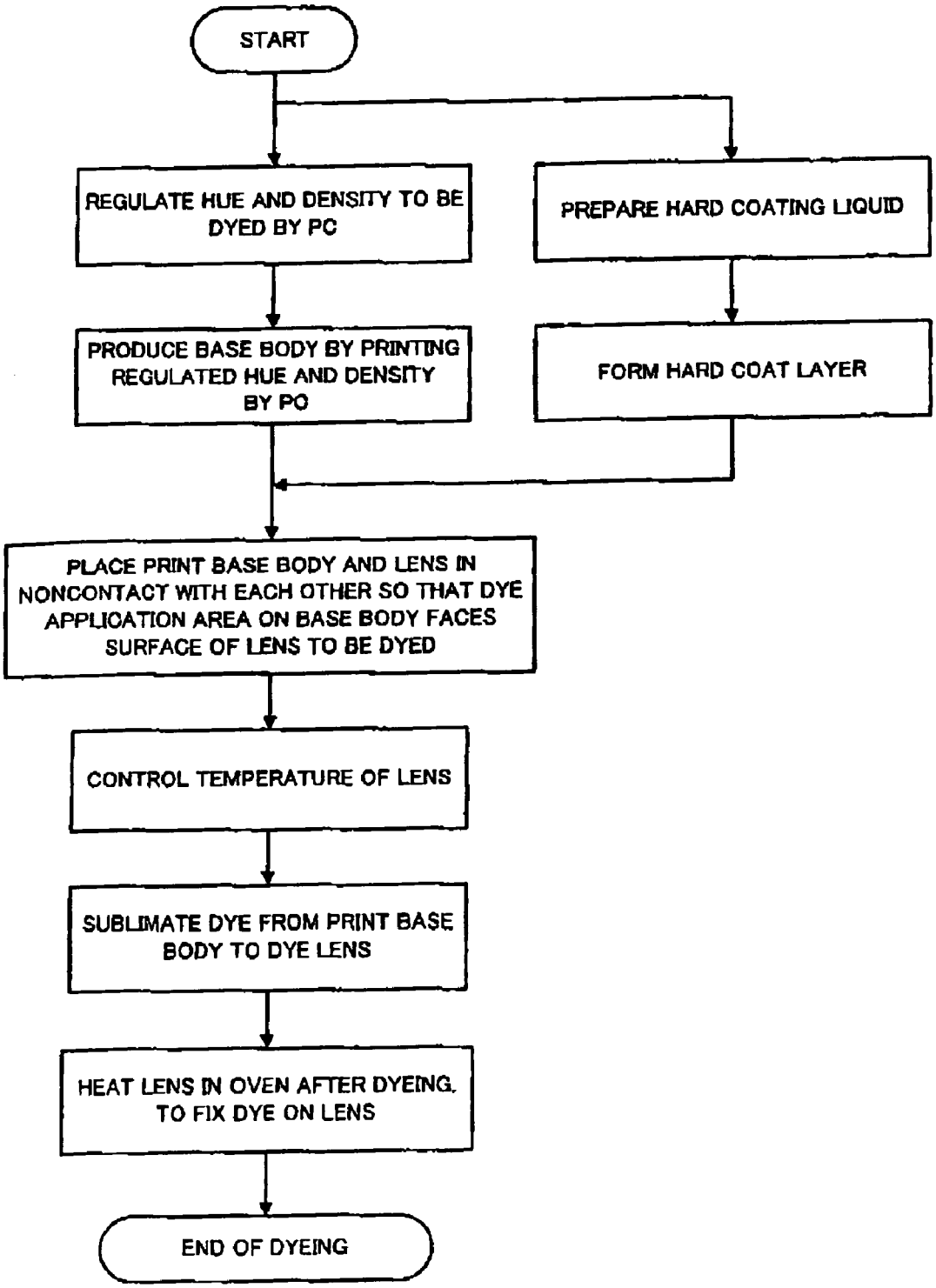
FIG. 2 is a flowchart showing the flow of dyeing.

A detailed description of a preferred embodiment of a method of dyeing a plastic lens and a dyeing device embodying the present invention will now be given referring to the accompanying drawings. FIG. 1 is a schematic structural view of a plastic lens dyeing system in the present embodiment. FIG. 2 is a flowchart showing the flow of dyeing.

<Production of a Print Base Body (a Base Body for Dyeing)>

At first, a print base body 1 to be used for dyeing a plastic lens 10 (hereinafter, simply referred to as a lens) is produced. On the body 1, a sublimatable dye (a dyeing solution) is printed or applied.

As the sublimatable dye (which contains a dissolved or fine-grained dispersed sublimatable dye), there are used four dispersion dye inks of red, blue, yellow, and black (if needed). These inks are separately filled in ink cartridges for an ink jet printer. The cartridges are set in an ink jet printer 110.

The print base body 1 is made by use of a personal computer (PC) 100 and the printer 110. The PC 100 is used to regulate the hue and density (which are hereinafter referred all together to as "color") to be printed. The color is regulated by use of a drawing software, a CCM (computer color matching), or the like, on the PC 100. Accordingly, data on the desired color can be stored in the PC 100 so that the base body 1 with the same color can be repeatedly produced as needed.

Figure 3:
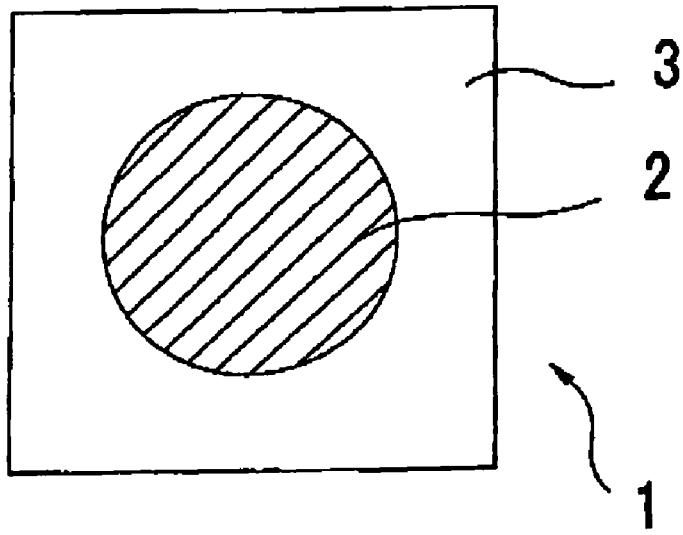
FIG. 3 is a plane view of a print base body.

A print sheet 3 which forms the base body 1 is set in the printer 110. The PC 100 is then operated to carry out printing based on the preset data on the desired color. On the front face of the print sheet 3 (the base body 1), a circular colored layer 2 which is an area applied with the dye is printed as shown in FIG. 3. The diameter of the colored layer 2 is preferably determined to be larger than the diameter of a surface of the lens 10 to be dyed. If the diameter of the colored layer 2 is shorter than the surface of the lens 10 to be dyed, there is a possibility that the entire surface of the lens 10 could not be sufficiently dyed. The print sheet 3 used for the production of the base body 1 is a sheet having an entirely black-colored back face (on which no colored layer is printed) for the purpose of enhancing the efficiency of heat absorption.

<Dyeing of a Plastic Lens>

Figure 4:
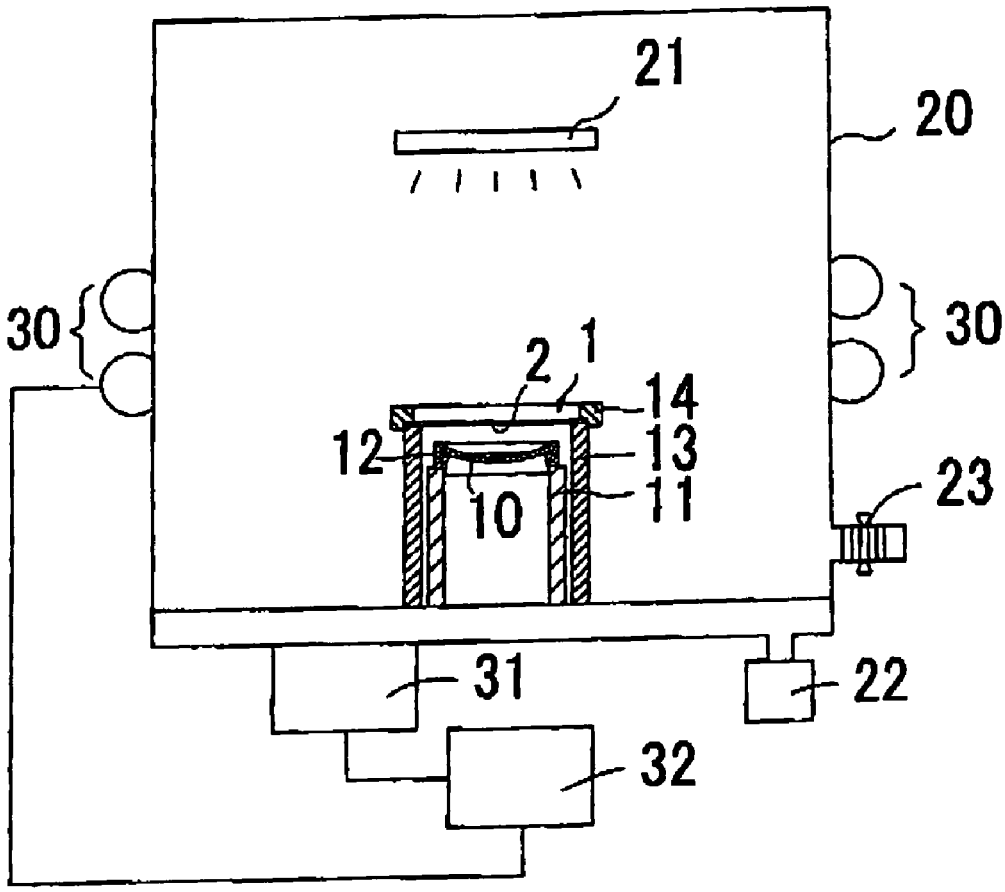
FIG. 4 is a schematic structural view of a vacuum vapor deposition transfer device.

FIG. 4 shows a schematic structural view of a vacuum vapor deposition transfer device (hereinafter, referred to as a vapor deposition device) 20 .

A casing of the vapor deposition device 20 is made of a material with good thermal conductivity, for example, aluminum. The device 20 is provided at its front with a door not shown which is opened/closed for allowing insertion/removal of the plastic lens 10, the base body 1, and others. In the device 20, a heating lamp 21 serving as a heating source to heat the base body 1 to thereby sublimate the dye is disposed in an upper place. It is to be noted that the lamp 21 in the present embodiment is a halogen lamp, but not limited thereto. Any lamps capable of heating the base body 1 in noncontact relation therewith may be used.

Numeral 22 is a rotary pump which is used to produce almost a vacuum in the vapor deposition device 20. Numeral 23 is a leak valve which is opened to admit outside air into the device 20, thereby returning almost the vacuum in the device 20 to atmospheric pressure.

Numeral 30 is a cooler mounted circumferentially on the external wall of the vapor deposition device 20 in contact relation therewith. In this cooler 30, cooling water maintained at a predetermined temperature is circulated. Numeral 31 is a temperature sensor disposed on the bottom of the external wall of the vapor deposition device 20. Numeral 32 is a controller. The temperature sensor 31 detects the temperature of the external wall of the device 20 and the controller 32 sequentially monitors changes in the temperature. When the detected temperature reaches a predetermined temperature (30° C. in the present embodiment), the controller 32 drives the cooler 30 to restrain a rise in the temperature of the vapor deposition device 20 by heat exchange so as not to allow the temperature rise to more than the predetermined temperature. The controller 32 further controls a display not shown to display the temperature of the external wall.

In the dyeing using the conventional vapor deposition method, the temperature of the vapor deposition device 20 would become gradually higher when the device 20 is continuously used to dye lenses in succession. When the lens 10 is put in the device 20 in such state, the lens 10 would be influenced by the ambient temperature and therefore the temperature of the lens 10 itself would rise before a dyeing operation (herein, before turn-on of the lamp 21). The higher the temperature of the lens 10, the paler or lighter the color density of the dyed lens 10 would become, which results in unstable reproducibility. This is considered as resulting from that the sublimed dye is hard to adhere to the lens 10 of which the temperature is high or the dye adhered to the lens 10 sublimes again.

On this account, in the present embodiment, an increase in temperature of the vapor deposition device 20 is restrained to prevent the temperature of the lens 10 from rising before the dyeing operation, thereby achieving stable dyeing reproducibility. The temperature of the lens 10 is preferably controlled to a temperature at which color density can be produced within a predetermined color difference with respect to the desired color density. Specifically, the temperature of the lens 10 is preferably brought to 70° C. or less, more preferably, 50° C. or less. If the temperature of the lens 10 exceeds 70° C., it becomes difficult to produce the color density within a predetermined color difference with respect to the desired color density. It is to be noted that the upper limit of such temperature somewhat varies with the property of a sublimatable dye to be used.

In the present embodiment, the temperature of the lens 10 is controlled to bring the upper limit to 70° C. or less, but not limited thereto. The temperature of the lens 10 may be controlled to be kept at a constant temperature. The higher the temperature of the lens 10 before the dyeing operation, the more likely a difference in color density occurs due to a difference in temperatures of the lens 10 before and in the dyeing operation. Therefore, it is preferable to control the temperature of the lens 10 so as to be as low as possible and fall within a predetermined temperature difference.

In the present embodiment, furthermore, the cooler 30 is mounted on the external wall of the vapor deposition device 20, but not limited thereto. Any structure capable of preventing a rise in the temperature of the lens 10 placed inside the vapor deposition device 20 may be adapted. For instance, the cooler 30 may be installed on the internal wall of the vapor deposition device 20.

Numeral 15 is a dyeing jig for placing the lens 10 and the base body 1 in the vapor deposition device 20 so that the lens surface to be dyed and the colored layer 2 are held facing each other in noncontact relation. Numeral 13 is a cylindrical support for supporting the base body 1. This support 13 is placed in the vapor deposition device 20 so that a lens support 11 is positioned inside the support 13. Numeral 12 is a lens holder for holding the lens 10 on the lens support 11. Numeral 14 is a retainer which presses the base body 1 against the base body support 13. Thus, the base body 1 put on the support 13 is securely held between the support 13 and the retainer 14.

In the dyeing using the vapor deposition method, if the spacing (distance) between a target surface of the lens 10 to be dyed and the base body 1 (the colored layer 2) is extremely too small, the dye could not sufficiently be dispersed, which likely deposits nonuniformly to the target surface of the lens 10. If the spacing between the target surface of the lens 10 and the base body 1 is too large, to the contrary, the target surface would be dyed in pale or light color density. Consequently, the desired color density could not be obtained. In addition, particles of the dye could not be dispersed uniformly in vapor, conversely, the particles would gather and likely deposit nonuniformly to the target surface of the lens 10. Herefrom, the distance between the geometric center of the target surface of the lens 10 to be dyed and the base body 1 is set at preferably about 1 mm to 30 mm, more preferably about 5 mm to 20 mm.

The base body 1 and the lens 10 are set in the jig 15 previously placed in the vapor deposition device 20 (alternatively, the jig 15 in which the base body 1 and the lens 10 are set in advance may be put in the device 20). The pump 22 is then operated to produce almost a vacuum in the vapor deposition device 20. This vacuum is produced by reducing the pressure in the device 20 to about 0.1 to 10 kPa. The vacuum may be below 0.1 kPa, but it will require a high-powered exhauster. On the other hand, the higher the pressure in the device 20, the higher the temperature needed for sublimation of the dye. Therefore, the upper limit of the pressure is preferably up to about 10 kPa, more preferably in a range of about 1 to 4 kPa.

When the pressure in the vapor deposition device 20 is reduced to a predetermined pressure, the lamp 21 is turned on to heat the base body 1 from above, thereby sublimating the dye. If the heating temperature on the base body 1 is below 100° C., the dye will be hard to sublimate. If the heating temperature exceeds 300° C., the dye will be more apt to change in quality. Accordingly, the heating temperature is preferably determined in a range of 100 to 300° C. In addition, the heating time is preferably as short as possible. This is because the temperature of the lens 10 is more increased as the heating time is longer, so that the color reproducibility becomes unstable. Consequently, the heating time is preferably within 5 min., more preferably, within 2 min.

After the dyeing in the vapor deposition device 20, the lens 10 is put in an oven 50 and heated under normal pressures to fix or set the deposited dye on the lens 10. This fixation process is carried out in the following steps of; heating the lens 10 in the oven 50 at a temperature set as high as possible below a resistible temperature of the lens 10; and taken the lens 10 out of the oven 50 after a lapse of the previously determined time needed to obtain a desired color. The heating temperature of the oven 50 is preferably about 50° C. to 150° C. and the heating time is preferably about 30 min. to 2 hours.

The material of the lens 10 is selected from a polycarbonate resin (e.g., diethylene glycol bisallyl carbonate polymer (CR-39)), a polyurethane resin, an allyl resin (e.g., allyl diglycol carbonate and its copolymer, and diallyl phthalate and its copolymer), a fumaric acid resin (e.g., benzyl fumarate copolymer), a styrene resin, a polymethyl acrylate resin, a fiber resin (e.g., cellulose propionate), etc. Furthermore, a material with a high refractive index such as a thiourethane type, a thioepoxy type, and the like, and other materials with a high refractive index which have conventionally been regarded as having low (inferior) dyeability may be used.

EXPERIMENTS

The following explanations are made on the results of Experiments 1-6 conducted to evaluate the color density of the dyed lenses of which temperatures have been controlled to different values before the dyeing operation.

Experiment 1

In this experiment, a lens CR-39 was used as the lens 10. The sublimatable inks (dyes) were Red (Kayaron Light Red BS, Nippon Kayaku Co., Ltd.), Yellow (Kayaron Yellow AQ-LE, Nippon Kayaku Co., Ltd.), and Blue (Dianix Blue AC-E, DyStar Japan Co., Ltd.). The dispersant was Demol MS (Kao Corporation). The ink prescription was as shown in Table 1.

TABLE 1

| | RED | YELLOW | BLUE |
|---|---|---|---|
| Dye | 5.0 wt % | 8.0 wt % | 10.0 wt % |
| Dispersant | 2.5 wt % | 4.0 wt % | 5.0 wt % |
| Pure water | 92.5 wt % | 88.0 wt % | 85.0 wt % |

Each ink (red, yellow, and blue) was agitated for 10 min. or more and then treated by an ultrasonic homogenizer. Each ink was suction-filtered by use of a filter having a 1 μm-particle holding ability to remove particles of a large diameter, foreign substances, etc. Pure water was added to each ink to adjust the ink density to a specified density level. Thus, each ink was finished.

Each ink prepared as above was filled in the printer 110 (RJ-1300V2, Mutoh Industries Ltd.). The PC 100 and the printer 110 were used to print a circle (colored layer 2) of 95 mm in diameter on a sheet 3 (a gloss paper, Mitsubishi Paper Mills Ltd.), which is used as the base body 1. The print data was output at a discharge amount of 50% through each head (each color).

In the vapor deposition device 20, a heating plate was placed under the jig 15 (the lens support 11). The cooler 30 was driven to control the temperature of the lens 10. The temperature of the lens 10 was measured by a bimetal surface thermometer.

The dyeing operation was carried out in the following steps. After the base body 1 and the lens 10 were put in the above manner in the vapor deposition device 20, the pump 22 was operated to produce a vacuum of 1 kPa in the device 20. When a stable vacuum was produced, the lamp 21 was turned on to heat the base body 1 to sublimate the dye, thus depositing the sublimed dye on the lens 10. This heating time of the base body 1 was set at 40 seconds so that the temperature on the base body 1 finally reached 250° C. in 40 seconds. In the experiment 1, the temperature of the undyed lens 10 was 18.8° C. before the dyeing operation. After the dyeing operation, the lens 10 was taken out and then heated in the oven 50 to fix (develop) the dye. The heating temperature of the oven 50 was set at 135° C. and the heating time was 1 hour.

The dyed lens 10 was measured by a color meter (DOT-3 (a D65-10 light source), Murakami Color Research Laboratory). The measured result is shown in Table 2, wherein L* indicates luminance (brightness), a* is a constituent element representing a hue in a range of red-green, b* is a constituent element representing a hue in a range of blue-yellow, and ΔE* is a difference in color density (i.e., a color difference) with reference to the color density obtained in the experiment 1.

Experiments 2-6

In experiments 2-6, the heating plate was controlled to heat the lenses 10 to 30.2° C., 49.2° C., 57.3° C., 72.1° C., and 86.0° C. respectively before the dyeing operations. Other conditions were the same as in the experiment 1. The dyed lenses 10 were measured in the same manner in the experiment 1. The measured results are shown in Table 2.

TABLE 2

| | Temp. (° C.) | L* | a* | b* | ΔE* (with reference to Ex. 1) |
|---|---|---|---|---|---|
| Experiment 1 | 18.8 | 73.25 | −0.15 | −4.75 | — |
| Experiment 2 | 30.2 | 73.22 | −0.03 | −4.82 | 0.14 |
| Experiment 3 | 49.2 | 73.29 | −0.12 | −4.76 | 0.05 |
| Experiment 4 | 57.3 | 73.68 | −0.01 | −4.51 | 0.51 |
| Experiment 5 | 72.1 | 74.10 | 0.02 | −4.33 | 0.96 |
| Experiment 6 | 86.0 | 76.73 | 0.09 | −4.10 | 3.55 |

As shown in Table 2, there is little difference in L* of the dyed lenses 10, of which the respective temperatures were controlled to about 50° C. or less (Experiment 3) before the dyeing operation, but differences in L* and ΔE* appear in the dyed lenses 10, of which the temperatures were controlled to more than 50° C. before the dyeing operation. In the spectacle lens industry, generally, the lenses having a color difference of about 2.0 are accepted as products. Considering the dyed lens 10 obtained in the experiment 1 as a reference, it is preferable to control the temperature of the undyed lens 10 to 70° C. or less, more preferably 50° C. or less. Furthermore, the results in Table 2 show that the color density was apt to become paler (lighter) as the temperature of the lens 10 was higher during dyeing, even when the same dyeing ink was used. In order to stabilize the color reproducibility of the dyed lens 10, accordingly, it is preferable to control the temperature of the undyed lens 10 to as low as possible. In the case where the temperature of the lens 10 is high, it is preferable to control the temperature so as not to change during dyeing so that the temperature of the lens 10 is within a predetermined temperature difference.

Next, a method of dyeing a plastic lens subjected to a hard coating treatment is explained.

<Preparation of Hard Coating Liquid>

A composition of a hard coating liquid to be used in the present invention includes tetrafunctional silane as a main component and, in addition, an organic silicon compound (silicide) appropriately selected from among bifunctional silane, trifunctional silane, etc. and a metal oxide sol used for increasing an index. Of those organic silicon compounds, the tetrafunctional silane acts to improve the hardness of the produced hard coat layer. However, the tetrafunctional silane has no free radical chain and therefore the three-dimensional crosslinking density of the hard coat layer is increased as a compounding ratio of the tetrafunctional silane in the hard coating liquid is higher. Consequently, the plastic lens with the hard coat having highly efficient abrasion-resistance would be hard to dye by the dip dyeing method.

According to the present invention, on the other hand, the lens with the hard coat can be dyed even where the hard coating liquid contains the tetrafunctional silane of an amount that the lens is hard to dye by the dip dyeing method. An applicable compounding ratio of the tetrafunctional silane in the present invention is 30% or less by weight with respect to a total solids content in the hard coating liquid including the metal oxide sol used for increasing the index of the hard coat.

According to the dyeing method of the present invention, it is possible to naturally dye a hard-coated lens which can be dyed by the dip dyeing method and also to dye even another hard-coated lens which is hard to dye by the dip dyeing method, for example, a lens having a physical property value that the hard-coated lens surface is abraded by about 6 to 19 scratches by twenty strokes of a steel wool #0000 under a load of 1.5 kg.

The tetrafunctional silane used in the present invention is selected from among, for example, tetramethoxysilane, tetraethoxysilane, tetrapropoxysilane, tetrabutoxysilane, or the like.

The trifunctional silane is selected from among, for example, the trifunctional silane having a glycidyl group such as glycidoxy methyl trimethoxysilane, glycidoxy methyl triethoxysilane, glycidoxy methyl tripropoxysilane, α-glycidoxy ethyl trimethoxysilane, α-glycidoxy ethyl triethoxysilane, β-glycidoxy ethyl trimethoxysilane, β-glycidoxy ethyl triethoxysilane, β-glycidoxy ethyl tripropoxysilane, α-glycidoxy propyl trimethoxysilane, α-glycidoxy propyl triethoxysilane, α-glycidoxy propyl tripropoxysilane, β-glycidoxy propyl trimethoxysilane, β-glycidoxy propyl triethoxysilane, β-glycidoxy propyl tripropoxysilane, γ-glycidoxy propyl trimethoxysilane, γ-glycidoxy propyl triethoxysilane, γ-glycidoxy propyl tripropoxysilane, and the trifunctional silane having an ureidoalkyl group such as ureidomethyl trimethoxysilane, ureidoethyl trimethoxysilane, ureidopropyl trimethoxysilane, ureidomethyl triethoxysilane, ureidoethyl triethoxysilane, ureidopropyl triethoxysilane, or the like The bifunctional silane is selected from among, for example, glycidoxy methyl methyl dimethoxysilane, glycidoxy methyl methyl diethoxysilane, glycidoxy methyl methyl dipropoxysilane, glycidoxy methyl ethyl dimethoxysilane, glycidoxy methyl ethyl diethoxysilane, glycidoxy methyl ethyl dipropoxysilane, α-glycidoxy ethyl methyl dimethoxysilane, β-glycidoxy ethyl methyl dimethoxysilane, α-glycidoxy ethyl methyl diethoxysilane, β-glycidoxy ethyl methyl diethoxysilane, α-glycidoxy ethyl methyl dipropoxysilane, β-glycidoxy ethyl methyl dipropoxysilane, α-glycidoxy propyl methyl dimethoxysilane, β-glycidoxy propyl methyl diethoxysilane, γ-glycidoxy propyl methyl diethoxysilane, α-glycidoxy propyl methyl diethoxysilane, β-glycidoxy propyl methyl diethoxysilane, γ-glycidoxy propyl methyl diethoxysilane, α-glycidoxy propyl methyl dipropoxysilane, β-glycidoxy propyl methyl dipropoxysilane, γ-glycidoxy propyl methyl dipropoxysilane, or the like.

From among the above bifunctional and trifunctional organic silicon compounds (silicides), a single kind or two or more kinds can be selected to be used for the composition of the hard coating liquid which is used in the present invention.

Furthermore, the composition of the hard coat of the present invention contains a metal-oxide sol in order to increase an index of the hard coat. This metal oxide sol is made by dispersing, in a colloidal state, one or more kinds of metal oxide selected from among $SiO_2$, $Al_2O_3$, $SnO_2$, $TiO_2$, $ZrO_2$, $Fe_2O_3$, ZnO, $In_2O_3$, etc. into solvent such as water, alcohol, etc.

The composition of the hard coat in the present invention may additionally contains as needed, in addition to the above components, a curing catalyst, a surface active agent, an anti-oxidizing agent, an ultraviolet absorbing agent, a light stabilizer, a pigment, a dye, and the like in slight amounts to improve an application property, liquid quality, coating quality, and others of the hard coating compositions.

The base material (plastic lens) to which the hard coating composition of the present invention is applied may be a plastic base material generally used for spectacle lenses, for example, polymethyl methacrylate (PMMA), polycarbonate, polythiourethane, etc. The method of forming the hard coat on the plastic lens may be a well known method, for example, brush coating, dipping, spray painting, and spin coating.

To produce the hard coating composition with high performance, it is preferable to cause all kinds of materials to react as uniformly as possible. Accordingly, the temperature during the preparation of the hard coating composition is preferably controlled to be low (30° C. or less). It is further preferable to agitate the materials in a vessel slowly, without increasing the agitating speed, so as to cause the materials to react slowly.

EXAMPLE 1

At first, a hard coating liquid was prepared as below to form a hard coat layer on a plastic lens. 118 parts by weight of tetraethoxysilane and 118 parts by weight of γ-glycidoxy propyl trimethoxysilane were put in a reaction vessel, and 118 parts by weight of methanol was added as solvent. This mixture was agitated at room temperatures for 2 hours.

Furthermore, 136 parts by weight of a 0.01N hydrochloric acid solution was dropped into the above mixture under agitation. This mixture was agitated at room temperatures for 24 hours. After the agitation, 94 parts by weight of methanol, 59 parts by weight of isopropyl alcohol, and 59 parts by weight of diacetone alcohol were added as the solvent to the above mixture, which was agitated at room temperatures for 2 hours.

Thereafter, 259 parts of weight of a $TiO_2$ sol (Optlake 1120F, Catalysts & Chemicals Ind. Co., Ltd.) was added as the metal oxide sol and agitated at room temperatures for 2 hours. Successively, 24 parts by weight of methanol and 16 parts by weight of diacetone alcohol as the solvent, a slight amount (1 part by weight) of acetylacetone aluminum as the catalyst, and a slight amount (0.2 part by weight) of SH28PA (Toray Dow Corning Silicone Co., Ltd.) as the surface active agent were added and agitated at room temperatures for 24 hours. Thus, the hard coating composition was produced.

The produced hard coating composition was applied to a thiourethane plastic lens (MR-8) of a 1.60 refractive index by the dipping method. The lens has previously been subjected to surface treatment by alkali cleaning or plasma treatment.

According to the dipping method, the lens was dipped into the hard coating composition to form a coat at a pull-up speed of 600 mm/min. The lens with the coat was preliminarily dried at 80° C. for 5 min. and finally dried at 120° C. for 1 hour, thus completing a hard coated lens.

Successively, the hard coated lens 10 obtained in the above manner was set in the jig 15 in the vapor deposition device 20 and dyed according to the vapor deposition method as follows. The inks used in the printer 110 (RJ-1300V2, Mutoh Industries Ltd.) were red (Sumikaron Red E-FBL, Sumitomo Chemical Co., Ltd.), yellow (kayaron Yellow AQ-LE, Nippon Kayaku Co., Ltd.), and blue (Dianix Blue AC-E, DyStar Japan Co., Ltd.). The dispersant was Demol MS (Kao Corporation). The ink prescription of each color (red, yellow, and blue) was 10.0 wt % of the disperse dye, 5.0 wt % of the dispersant, and 85.0 wt % of pure water. Each ink was completely prepared according to the above mentioned ink preparing manner. Then, the PC 100 and the printer 110 were used to produce the base body 1.

The base body 1 and the lens 10 were put in the vapor deposition device 20. The dyeing operation was carried out under conditions that the degree of vacuum was 1 kPa and the temperature on the base body 1 was 250° C. After a lapse of time sufficient to sublimate almost all the dye on the base body (about 3 min.), the dyed lens 10 was taken out of the vapor deposition device 20. The lens 10 was put in the oven 50 and heated at the heating temperature of 135° C. for 1 hour. The dyeing operation on the lens 10 was completed.

The dyed lens 10 was measured by the color meter. The measured color data is shown in Table 3, wherein Y indicates luminous transmittance, L* indicates luminance (brightness), a* is a constituent element representing a hue in a range of red-green, b* is a constituent element representing a hue in a range of blue-yellow.

TABLE 3

| Y | L* | a* | b* |
|---|---|---|---|
| 44.39 | 72.49 | (+)1.18 | (+)17.34 |

As shown in Table 3, the lens 10 was dyed in brown of the color density of about 50%.

Furthermore, it was checked whether this hard coated lens could be dyed by the conventional dip dyeing method. The dyeing solution was prepared by putting 0.6 g of Kayaron Light Red BL-Se (Nippon Kayaku Co., Ltd.), 5.0 g of Sumikaron Yellow E-RPD (E) (Sumitomo Chemical Co., Ltd.), 2.0 g of Sumikaron Blue SE-RPD (Sumitomo Chemical Co., Ltd.), 5.0 g of sodium dodecylbenzenesulfonate, and 1.0 g of FC-170C (Sumitomo 3M Ltd.) into a stainless vessel. Pure water was further added to provide the dyeing solution in a total amount of 1L. The mixture (dyeing solution) was fully agitated and kept at a water temperature of 92° C. The hard coated lens was dipped into the dyeing solution for 20 min. Then, the lens was taken out therefrom, sufficiently rinsed in pure water, and destained with acetone. The dyed lens was thus obtained.

This lens dyed by the dip dyeing method was measured by the color meter and the measured color data are shown in Table 4.

TABLE 4

| Y | L* | a* | b* |
|---|---|---|---|
| 80.14 | 91.75 | (−)2.01 | (+)0.45 |

As shown in Table 4, the lens could only be dyed slightly.

By use of the dye used in the above mentioned vapor deposition method, the dyeing using the conventional dip dyeing method was performed. The dyeing solution was prepared by putting 20 parts by weight of Sumikaron Red E-FBL (Sumitomo Chemical Co., Ltd.), 20 parts by weight of Kayaron Yellow AQ-LE (Nippon Kayaku Co., Ltd.), 20 parts by weight of Dianix Blue AC-E (DyStar Japan Co., Ltd.), and 50 parts by weight of sodium dodecylbenzenesulfonate, and 10 parts by weight of FC-170C (Sumitomo 3M Ltd.) into a stainless vessel. Pure water was further added to provide the dyeing solution in a total amount of 1 L. The mixture (dyeing solution) was fully agitated and kept at a water temperature of 92° C. The hard coated lens was dipped into the dyeing solution for 1 hour. Then, the lens was taken out therefrom, sufficiently rinsed in pure water, and wiped out with acetone. The dyed lens was thus obtained.

The lens dyed by the dip dyeing method was measured by the color meter and the measured color data are shown in Table 5.

TABLE 5

| Y | L* | a* | b* |
|---|---|---|---|
| 85.04 | 93.90 | (+)0.22 | (−)0.36 |

As shown in Table 5, the lens could only be dyed slightly.

Next, tests to evaluate the physical properties of the hard coat of the hard coated lens dyed by the vapor deposition method were executed in the following manner. The evaluation results are shown in Table 6. The weight ratio of main materials shown in Table 6 indicates only a solids content by weight in the hard coating liquid.

Abrasion Test

An abrasion test was conducted under the condition that a coated lens surface was rubbed with a steel wool #0000 under a load of 1.5 kg. After 5 strokes and 20 strokes of the steel wool, respectively, the states of the coat were observed by the naked eye and the level of each state was determined from among A: very few scratches (0-5 scratches), B: some scratches (6-19 scratches), and C: many scratches (20 or more scratches).

Adhesion Test

An adhesion test was carried out under the condition that a lens surface was formed with 100 grids at intervals of 1 mm by use of a cutter and a peel test (a crosscut tape test) using an adhesive cellophane tape was performed three times to check the number of remaining grids.

Appearance Test

The hard coated lens was checked by the naked eye in relation to transparency, a colored state, and a surface state.

EXAMPLE 2

93 parts by weight of tetraethoxysilane, 106 parts by weight of γ-glycidoxy propyl trimethoxysilane, 79 parts by weight of ureidopropyl triethoxysilane (dilution with 50 wt % of methanol), 23 parts by weight of γ-glycidoxy propyl methyl diethoxysilane, 223 parts by weight of a $TiO_2$ sol (Optolake 1130F2 (A-8), Catalysts & Chemicals Ind. Co., Ltd.) as the metal oxide sol, and 97 parts by weight of 2-pentanone as the solvent were mixed and agitated at room temperatures for 2 hours.

Furthermore, 140 parts by weight of a 0.01N hydrochloric acid solution was dropped into the above mixture under agitation. This mixture was agitated at room temperatures for 24 hours. After the agitation, 24 parts by weight of diacetone alcohol and 56 parts by weight of acetylacetone were added and agitated at room temperatures for 2 hours.

In addition, a slight amount (2 parts by weight) of acetylacetone aluminum as the catalyst and a slight amount (1 part by weight) of Y-7006 (Nippon Unicar Co., Ltd.) as the surface active agent were added into the above mixture and agitated at room temperatures for 24 hours. The hard coating composition was thus obtained.

This hard coating composition prepared as above was used to form a hard coat on each lens (MR-8), which was made of the same material as that in the example 1, in the same steps as in the example 1.

The hard coated lenses produced as above were dyed by the vapor deposition method used in the present embodiment in the same manner as the example 1 and by the conventional dip dyeing method, respectively. Some of the lenses could be dyed by the vapor deposition method, but other lenses could only slightly be dyed by the dip dyeing method.

The same evaluation test as in the example 1 was executed. The evaluation results are shown in Table 6.

EXAMPLE 3

31 parts by weight of tetraethoxysilane, 83 parts by weight of γ-glycidoxy propyl trimethoxysilane, 124 parts by weight of ureidopropyl triethoxysilane (dilution with 50 wt % of methanol), 370 parts by weight of a $TiO_2$ sol (Catalysts & Chemicals Ind. Co., Ltd.) as the metal oxide sol, and 86 parts by weight of 2-pentanone as the solvent were mixed and agitated at room temperatures for 2 hours.

Furthermore, 86 parts by weight of a 0.01N hydrochloric acid solution was dropped into the above mixture under agitation. This mixture was agitated at room temperatures for 24 hours. After the agitation, 22 parts by weight of diacetone alcohol and 51 parts by weight of acetylacetone were added and agitated at room temperatures for 2 hours.

In addition, a slight amount (2 parts by weight) of acetylacetone aluminum as the catalyst and a slight amount (1 part by weight) of Y-7006 as the surface active agent were added into the above mixture and agitated at room temperatures for 24 hours. The hard coating composition was thus obtained.

This hard coating composition prepared as above was used to form a hard coat on each plastic lens (MR-7) in the same steps as in the example 1, thus producing hard coated lenses.

The hard coated lenses produced as above were dyed by the vapor deposition method used in the present embodiment in the same manner as the example 1 and by the conventional dip dyeing method (using the same kind of dyeing solution as in the example 1), respectively. Some of the lenses could be dyed by the vapor deposition method, but other lenses could only slightly be dyed by the dip dyeing method.

The same evaluation test as in the example 1 was also executed. The evaluation results are shown in Table 6.

COMPARATIVE EXAMPLE 1

As a comparative example, a hard coating liquid of the type allowing a lens to be dyed by the conventional dip dyeing method is mentioned below. The same evaluation as above was also made on this liquid.

61 parts by weight of tetraethoxysilane, 116 parts by weight of γ-glycidoxy propyl trimethoxysilane, 94 parts by weight of ethyl cellosolve as the solvent were mixed and agitated at room temperatures for 2 hours. Furthermore, 9 parts by weight of a 0.01N hydrochloric acid solution was dropped into the above mixture under agitation. This mixture was agitated at room temperatures for 24 hours. After the agitation, 71 parts by weight of titanium isopro-oxide, 49 parts by weight of isopropyl alcohol, 207 parts by weight of methanol, 94 parts by weight of ethyl cellosolve, and 120 parts by weight of 1,4-dioxane were added and agitated at room temperatures for 2 hours.

127 parts by weight of a 0.01N hydrochloric acid solution was dropped into the above mixture under agitation. This mixture was agitated at room temperatures for 24 hours. After that, 2 parts by weight of epoxy 5050 (epoxy resin), 1 part by weight of epoxy 827 (epoxy resin), 1 part by weight of $NH_4OH$, and 47 parts by weight of 1,4-dioxane were added and agitated at room temperatures for 24 hours. Thus, the hard coating composition was completed.

This hard coating composition prepared as above was used to form a hard coat on each lenses (MR-8), which was made of the same material as that in the example 1, in the same steps as in the example 1, thus producing hard coated lenses.

The hard coated lenses produced as above were dyed by the vapor deposition method used in the present embodiment in the same manner as the example 1 and by the conventional dip dyeing method (using the same kind of dyeing solution as in the example 1), respectively. The lenses could sufficiently be dyed by both the vapor deposition method and the dip dyeing method.

The same evaluation test as in the example 1 was also executed on the lenses. The evaluation results are shown in Table 6.

<Results>

As shown in Table 6, the hard coated lens which could hardly be dyed by the conventional dip dyeing method could also be dyed by the vapor deposition method in the present embodiment. It was also confirmed that the physical properties of the hard coat of the hard coated lens dyed by the vapor deposition method was higher in abrasion resistance as compared with the conventional dyeable hard coat.

As described above, according to the present invention, a plastic lens can be dyed by the vapor deposition method with stable reproducibility even when the dyeing operation is repeatedly performed.

Furthermore, a hard coated plastic lens can be dyed.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A dyeing method of a plastic lens, including the steps of:

making a hard coat layer on both surfaces of the lens by dipping the lens in a hard coating liquid including an organic silicone compound and a metal-oxide sol and containing tetrafunctional silane at a compounding ratio of 30% or less by weight with respect to the total solids content and in an amount that the lens is hard to dye by a dip dyeing method due to a three-dimensional crosslinking density of the tetrafunctional silane in making the hard coat layer, and obtaining a lens with hard coat layer having physical property value that each of the surfaces formed with the hard coat layer is abraded by about 6 to 19 scratches by twenty strokes of a steel wool #0000 under a load of 1.5 kg;

placing the lens with the hard coat layer in a vacuum vapor deposition device cooling the vacuum vapor deposition device to restrain a temperature of the lens placed in the vapor deposition device from rising above a predetermined temperature before a dyeing operation;

placing a base body for dyeing in the vapor deposition device, the base body having a dye application area in which a sublimatable dye is applied, so that the dye application area faces a surface to be dyed of the lens with the hard coat layer;

heating the base body in the vapor deposition device under almost vacuum to sublimate the dye, and depositing the sublimed dye on the hard coat layer of the lens; and heating the lens with the hard coat layer, deposited with the dye in an oven under atmospheric pressure to fix the deposited dye on the hard coat layer of the lens.

2. The dyeing method according to claim 1, within the base body is heated at a temperature in a range of 100° C. to 300° C. in the vapor deposition device.

3. The dyeing method according to claim 1, wherein the lens with the hard coat layer and the deposited dye is heated at a temperature in a range of 50° C. to 150° C. in the oven.

* * * * *